United States Patent [19]

Robson et al.

[11] Patent Number: 4,771,707

[45] Date of Patent: Sep. 20, 1988

[54] FUME INCINERATION SYSTEM FOR PAINT DRYING OVEN

[75] Inventors: John Robson, Kent, United Kingdom; Maximilian K. Carthew, Troy, Mich.

[73] Assignee: Haden Schweitzer Corporation, Madison Heights, Mich.

[21] Appl. No.: 587,666

[22] Filed: Mar. 8, 1984

Related U.S. Application Data

[62] Division of Ser. No. 493,858, May 12, 1983, Pat. No. 4,460,331.

[51] Int. Cl.[4] ..... F23G 7/06; F23J 15/00

[52] U.S. Cl. ..... 110/211; 110/214; 110/254; 432/72

[58] Field of Search ..... 110/210, 211, 214, 254; 432/72

[56] References Cited

U.S. PATENT DOCUMENTS

| | | | |
|---|---|---|---|
| 209,218 | 10/1878 | Bookwalter | 122/155 A |
| 1,101,872 | 6/1914 | Meachaur | 122/155 A |
| 2,171,535 | 9/1939 | Berg et al. | 110/254 |
| 3,043,246 | 7/1962 | Hebert | 110/211 |
| 3,747,542 | 7/1973 | Ruohola et al. | 110/214 |
| 3,867,102 | 2/1975 | Csathy | 110/254 |
| 3,898,040 | 8/1975 | Tabak | 110/211 |
| 3,947,235 | 3/1976 | Bornet | 432/72 |
| 4,098,567 | 7/1978 | Hubbert | 432/72 |
| 4,152,399 | 5/1979 | Germerdonk et al. | 432/72 |
| 4,324,545 | 4/1982 | Hubbert | 432/72 |

FOREIGN PATENT DOCUMENTS

| | | | |
|---|---|---|---|
| 52-59970 | 5/1977 | Japan | 110/210 |
| 2004627 | 4/1979 | United Kingdom | 110/210 |

*Primary Examiner*—Henry C. Yuen

*Attorney, Agent, or Firm*—Niro, Scavone, Haller, Niro & Rockey, Ltd.

[57] ABSTRACT

A fume incineration system for an industrial process site such as a paint-drying oven (10) producing a combustible effluent. A first duct system (34, 38, 42) conveys effluent to the incinerator (14). A second duct system (44, 48) conveys incinerated effluent back to the site. A third duct system (52, 56) conveys part of the incinerated effluent to an atmospheric vent (57). Control dampers (50, 74) in the duct systems operate sequentially to handle temperature changes, and control damper (84) controls system air flow balance. All ducts and thermal devices except the incinerator are located in an insulated housing (12). A thermal incinerator (14) having an internal preheater comprising an annular tube bundle is disclosed.

2 Claims, 2 Drawing Sheets

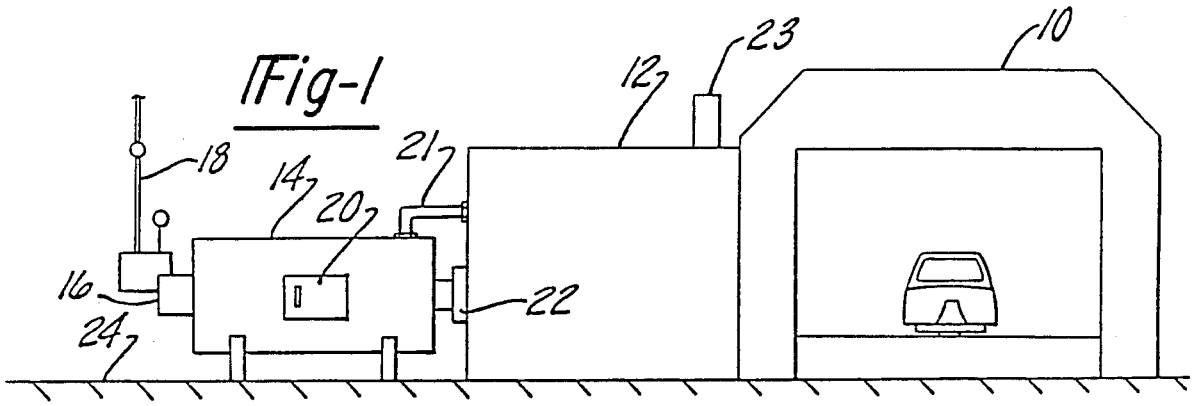
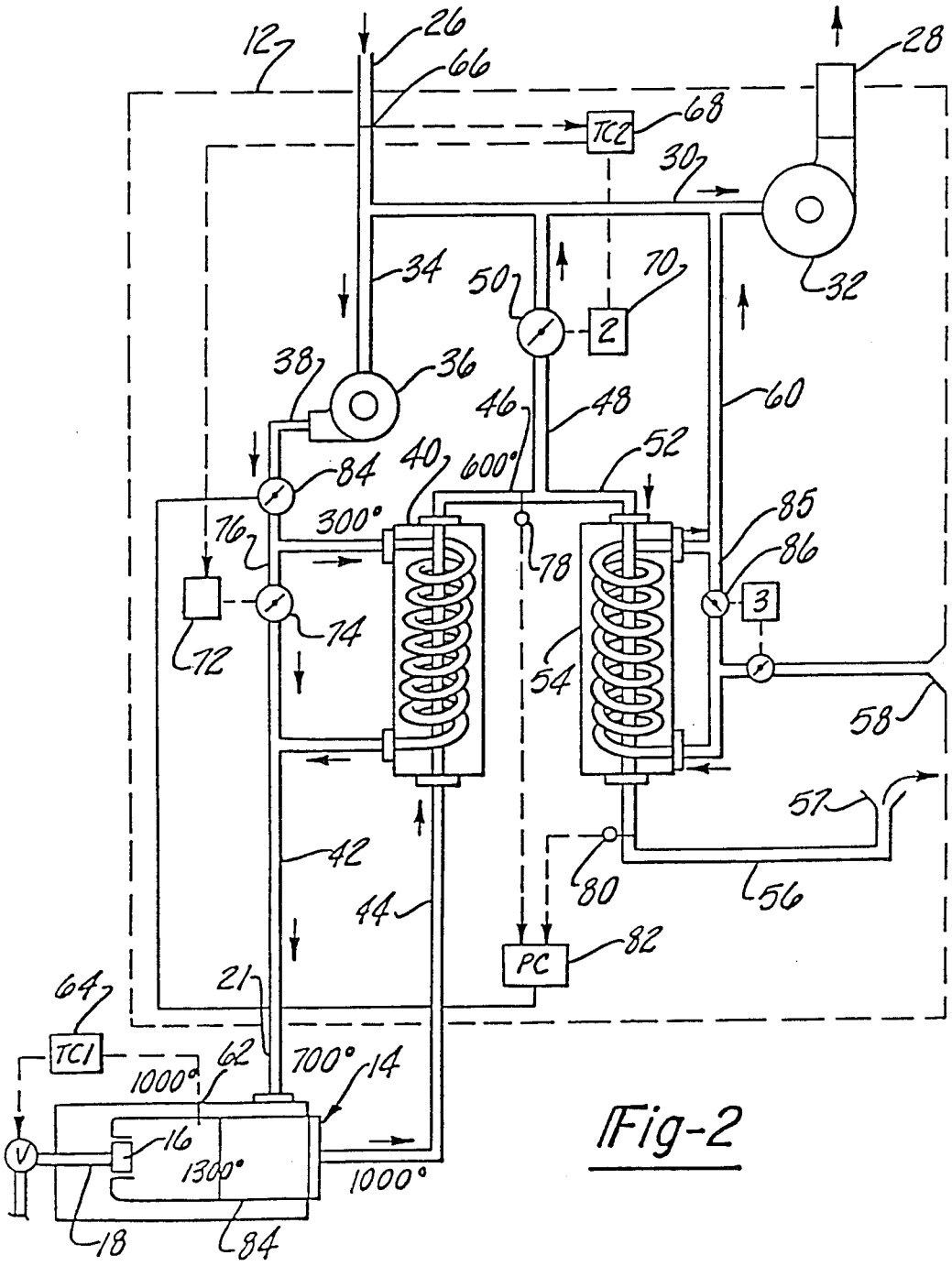
Fig-2

Fig-3
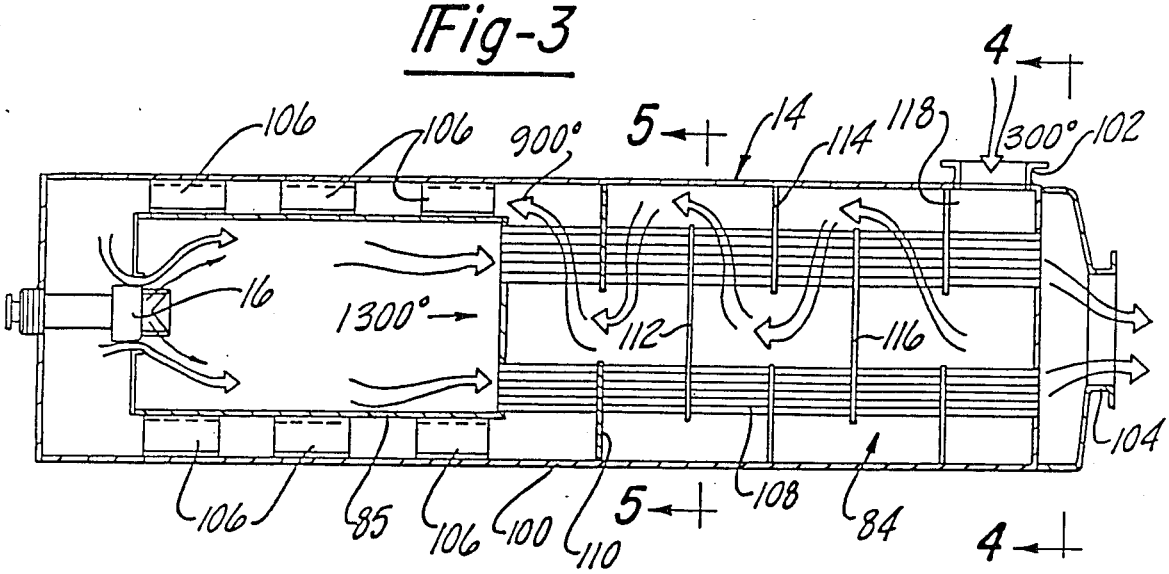
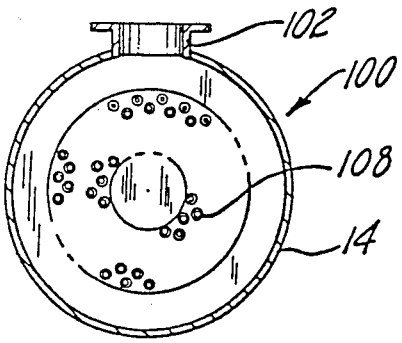
Fig-4
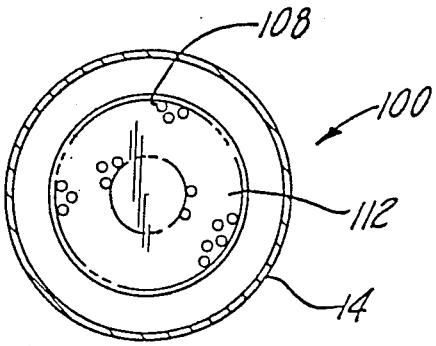
Fig-5
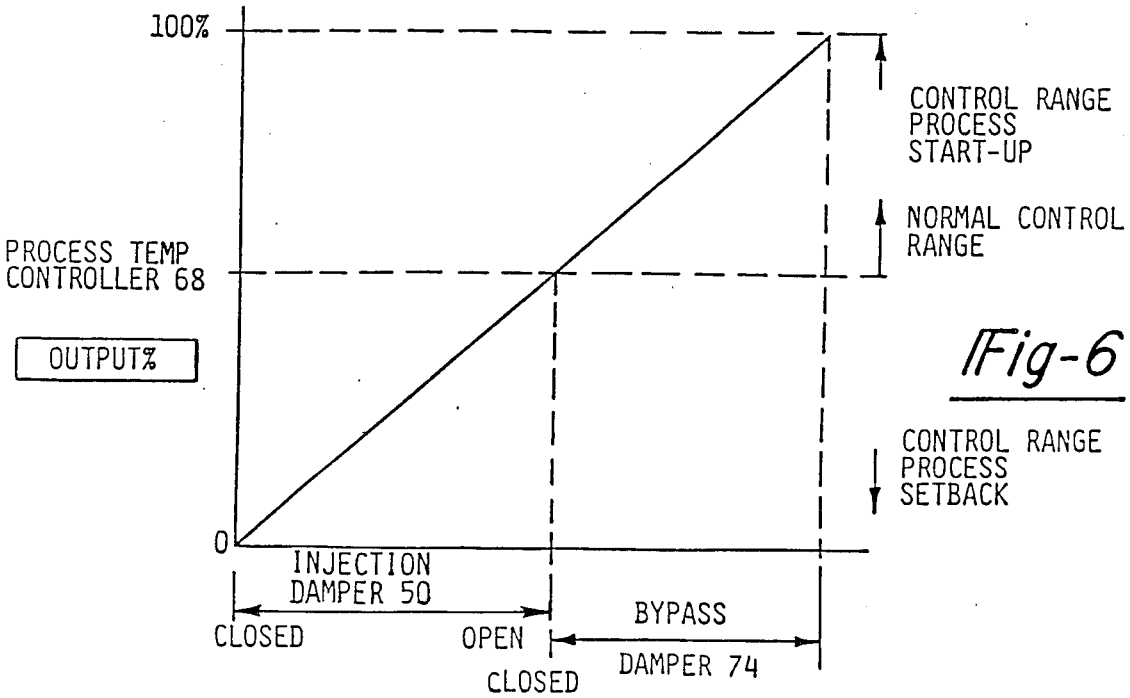
Fig-6

FUME INCINERATION SYSTEM FOR PAINT DRYING OVEN

This application is a division of application Ser. No. 493,858, filed May 12, 1983, now U.S. Pat. No. 4,460,331.

INTRODUCTION

This invention relates to fume incineration systems for industrial process sites such as paint and ink drying ovens, laminate curing ovens and the like which produce a combustible effluent, and particularly to a controlled air handling and incinerator apparatus for such a system.

BACKGROUND DISCUSSION

At one time, industrial process sites producing combustible and toxic effluent were simply vented to the atmosphere and fresh air was supplied in sufficient quantity to maintain the combustible content of the air at the site below explosive levels. As fuel prices rose and clean air laws were enacted, engineers began looking for ways to conserve energy used for heating and to clean up the exhaust air from the process site before venting it to the atmosphere.

An early step in the development of improved equipment involved the incineration of the combustible effluent and the use of heat exchanger principles to recover heat from the incinerator exhaust and to return it to the site.

A more recent development is disclosed in U.S. Pat. No. 4,255,132 issued Mar. 10, 1981, to Maximilian K. Carthew and assigned to the assignee of this application and invention. The system disclosed in U.S. Pat. No. 4,255,132 includes an incinerator which is supplied with exhaust air from an industrial process site and which functions as the primary heat source for the site. This is achieved through transfer of incinerator-produced heat to the make-up air supply. In addition, the patent teaches preheating the incinerated air and also providing a bypass around the heat exchanger to control the temperature of the system.

SUMMARY OF THE INVENTION

According to one aspect of the present invention, an improvement to the system disclosed in U.S. Pat. No. 4,255,132 is made by providing control means for responding to various levels of system demand and/or condition change to maintain predetermined temperatures or to maintain air flow balance. In particular, the system provides means for ducting combustible effluent to an incinerator and from the incinerator, in part, back to the process site and, in part, to an atmospheric vent or discharge. Control means are provided for reducing the volume of the incinerated effluent returned to the site and, when the discharge volume becomes excessive, for reducing the volume of effluent drawn from the site into the incinerator system.

According to another aspect of the invention, the incinerator for the exhaust air of an industrial process site is constructed as a module separate from other system components such as fans and heat exchangers. The latter components are placed within a large insulated housing interconnected with the incinerator module and connected as between themselves by ducts within the housing. From this arrangement, several advantages are realized. First, the incinerator module may be maintained, repaired, or replaced as necessary without the need to disturb other system components. Second, the internal ducting within the insulated housing minimizes the ingestion of particulates and other contaminants, such as dust. Third, the insulation of the housing eliminates the need for insulating the individual components and ducts within the housing.

According to a third aspect of the invention, an improved thermal incinerator structure is provided. In general, the incinerator includes an internal heat exchanger which preheats the input effluent and cools the exhaust. The heat exchanger includes a bundle of spaced, parallel exhaust tubes and support means to cause the input effluent to follow a tortuous path in and out of the tube bundle on its way to the incinerator combustion chamber. In a preferred embodiment, the structure includes a generally cylindrical housing having a burner disposed near one end, a combustion chamber disposed within the housing in radially spaced internal relationship therewith and occupying a portion of the axial length of the housing. The heat exchanger section occupies the balance of the axial length of the housing and conducts products of combustion from the combustion chamber to an outlet. The heat exchanger section comprises an annular tube bundle which, in combination with the housing, provides both axial internal and external flow passages, the latter lying between the bundle and the housing. Tube plates spaced along the tube bundle, force incoming air to flow in a mean axial direction to the burner through alternate and contiguous flow path segments lying in the internal and external flow passages and then over the combustion chamber itself to promote the transfer of heat from the products of combustion to the incoming air.

The various features and advantages of the invention will be best understood from a reading of the following detailed specification which describes a specific embodiment of the invention as applied to the treatment of air in a paint drying oven.

BRIEF DESCRIPTION OF THE DRAWINGS

FIG. 1 is a schematic drawing of an air handling and incineration system for a paint drying oven;

FIG. 2 is a detailed circuit diagram of the system;

FIG. 3 is a sectional drawing of an improved thermal heat exchanger for use in the system of FIG. 2;

FIG. 4 is a first sectional view of the incinerator;

FIG. 5 is a second sectional view of the incinerator; and

FIG. 6 is a control diagram.

DETAILED DESCRIPTION OF THE SPECIFIC EMBODIMENT

Referring to FIG. 1, a large paint drying oven 10 of such size and configuration for receiving freshly painted automobile bodies and components is located adjacent an insulated, metal housing 12 containing components of an air handling system hereinafter described in detail with reference to FIG. 2. An incinerator 14 is disposed immediately adjacent to the housing 12 and includes a gas burner 16 connected to a gas supply by way of line 18. The incinerator 14 includes an access hatch 20 in the cylindrical body thereof for servicing of internal components such as tubes and/or catalytic elements. An inlet 21 to the incinerator 14 receives air from the paint drying oven 10 through the insulated housing 12 as hereinafter described and the outlet end 22 of the incinerator 14 is connected back to the insulated housing 12 to return incinerated air and, therefore, purified air to the paint drying oven 10 or to exhaust the incinerated air to the atmosphere by way of a vent 23.

By locating the incinerator 14 adjacent to but outside of the insulated housing 12, direct access to the incinerator as well as to the internal components, thereof, is greatly facilitated; i.e., it is not necessary to enter the insulated housing 12 or to work around or otherwise disturb the intenral components thereof. The incinerator 14 may, for example, be a catalytic type device in which case it is necessary to periodically replace the catalytic cells within the body of the incinerator and this is most easily done if the incinerator is located outside of the housing 12. In addition, it may be desirable or necessary, under some circumstances, to convert the incinerator from a catalytic type to a thermal type or vice versa and, again, this is most easily handled if the device is separate from the components within the insulated housing 12.

Referring now to FIG. 2, air is drawn from the drying oven 10 through a duct 26 which enters into the insulated housing 12. Duct 26 is joined by a branch duct 30 which is connected to a supply fan 32 having an output 28 which returns to the drying oven 10. This interconnection of ducts 26, 28, and 30 simply circulates about 75% of the air which is drawn from the paint drying oven to provide a stirring function. The other 25% of the air received through duct 26 passes into duct 34 which is connected to an exhaust fan 36 for treatment purposes hereinafter described.

The output of exhaust fan 36 is connected through duct 38 to a first heat exchanger 40 where the exhaust air is elevated in temperature and furnished through duct 42 to the external incinerator 14 as previously described. Heat exchanger 40 represents a thermal connection between ducts 38, 44, 46 on thermally opposite sides of incinerator 14 to preheat the input to the incinerator and cool the output. In the case of a thermal or combined catalytic/thermal unit, the air passes into a preheater 84 and then into the combustion chamber through an end passage around burner 16. The air, after incineration, passes out through the preheater duct 44 and back through heat exchanger 40 to preheat the input air. The output of heat exchanger 40 passes through a duct 46 and a branch duct 48 containing a damper controller 50 back to duct 30 where a portion of the incinerated air is returned to the oven 10 through supply fan 32 and duct 28 as shown. The internal preheater 84 effectively lowers the output temperature of the incinerator 14 to about 800°-1,000° F. whereas without the preheater, the temperature might be above the capabilities of the structural materials used in the system. A catalytic incinerator normally operates at a low enough temperature that no internal preheater is required.

Reviewing briefly, the system as thus far described, provides a first function of simply recirculating air from and to the drying oven by way of ducts 26, 28, and 30 for stirring purposes and also returns a portion of incinerated air through a damper controller 50 to the drying oven. This second function eliminates a portion of the combustible fumes in the drying oven air and thus maintains the fume level within some predetermined limit; e.g., 0.25 L.E.L.

Continuing now with the description of the system of FIG. 2, duct 46 is connected to duct 52 which enters a second heat exchanger 54. An output duct 56 from heat exchanger 54 conveys a portion of the incinerated air to the atmospheric vent 57 at a reduced temperature and at a substantially reduced fume level. Air supply intake 58 draws atmospheric or ambient air into the system and through heat exchanger 54 where it is preheated to approximately 400° by air to air exchange with the portion of incinerated air entering the heat exchanger 54 through duct 52. This preheated make-up air flows through duct 60 to the supply fan 32 where it is mixed with the recirculated and incinerated air in duct 30 and forced through ducts 28 into the drying oven 10.

A bypass duct 76 containing a damper 74 permits air to flow around or bypass the heat exchanger 40 as necessary to maintain oven heat requirements. A further bypass duct 85, containing damper 86, permits air to flow around or bypass the heat exchanger 54 and is used for rapid cool down of the process drying oven.

Describing now the control components of the system of FIG. 2, a thermal sensor 62 in the combustion chamber of the incinerator 14 produces a signal related to internal temperature. The signal from sensor 62 is connected to controller 64 which controls the gas burner inlet valve in the gas supply line 18 to maintain the incinerator combustion temperature at a desired fixed level. A second temperature sensor 66 is connected into the drying oven return 26 to sense the temperature of the air in the drying oven as it is drawn into the return duct 26. This sensor provides a signal to a controller 68 which regulates the damper 50 by way of a controller 70 and also regulates damper 74 by way of controller 72. Referring to FIG. 6, it can be seen that process temperature control is achieved by modulating dampers 50 and 74 in sequence by the output from controller 68.

At start-up, when the system has purged and the burner is lit, the output from controller 68 goes from 0 to 100%. This opens damper 50 and damper 74 100%. In this way, the flow and temperature of air passing through damper 50 back to the oven is at maximum to achieve rapid process warm-up.

When the process is at temperature, the output from 68 falls, thus partially closing damper 74. Generally, the normal control range will be 50% to 80% output thus only damper 74 will modulate.

At times, it is necessary to stop the process for lunch breaks, etc., and at these times, the temperature is reduced and very little heat is required from the heater. At these times, the control 68 output falls to 0-50% which causes damper 74 to close first and then damper 50 to partially close. By reducing the amount of air passing back into the process via damper 50, the heat output is substantially reduced.

Now when the damper 50 is modulated, it has the effect of unbalancing the air flow to exhaust through ducts 52 and 56, and this could have serious effects on the process if not corrected. Therefore, an additional control loop is used comprising pressure sensors 78, 80, controller 82 and damper 84. This pressure control operates as follows:

The differential pressure across the exchanger 54 is sensed by sensors 78 and 80 and a signal is sent to controller 82 if the pressure changes from set point. The pressure tends to increase as damper 50 is closed, and controller 82 senses this increase and closes damper 84 to compensate. In this way, the exhaust fan output is adjusted to compensate for changes in damper 50 while maintaining the correct exhaust flow. A fan output control such as a variable pitch turbine or a speed control could be used as alternatives to damper 84.

Referring now to FIGS. 3 and 4, internal details of a thermal type incinerator 14 having an integral preheater are described. Incinerator 14 comprises a long cylindrical body 100 internally supporting burner 16 at one end, and inlet structure 102 and an outlet structure 104 at the other end. A cylindrical combustion chamber 84 is radially spaced within the left portion of the body 100 and supported by spacers 106 to provide an annular flow path around the outside of the combustion chamber 84 but within the housing 100 for purposes to be described. The combustion chamber 85 is directly connected to an annular tube bundle 108 which comprises a plurality of straight tubes through which the products of combustion and the incinerated air pass as seen in FIG. 3. The tube bundle is held in place by means of tubeplates 110, 112, 114, 116, 118. Tubeplates 110, 114, and 118 are large annular plates having holes to accommodate the tubes of tube bundle 108 and are welded around the outer periphery to the internal diameter surface of the housing 100. Tubeplates 112 and 116 are smaller diameter plates the radially outermost portions of which have holes to receive and support tubes in the tube bundle 108 and the central portion of which are solid. By means of this arrangement, it can be seen that a tortuous air path is provided outwardly and inwardly through the tube bundle 108 the mean direction of which is axially from right to left along the longitudinal axis of the unit. Accordingly, air entering the inlet 102 flows through the tubes of the tube bundle into an internal flow path segment and then is stopped by bulkhead 116 and forced to flow again through the tube bundle and into the first external flow path segment. Tubeplate 114 then forces the air flow back through the tube bundle and into the central flow path segment. Tubeplate 112 forces the air back through the tube bundle to an outside flow path segment and this alternate internal/external flow pattern continues until the air flows around the outside of the combustion chamber 85 and through the burner flame front into the internal volume of the combustion chamber. Air flowing throuth the tubes exits directly through the outlet 104 as shown. In this manner, an extremely efficient air to air heat exchanger function is provided.

In a preferred arrangement, the heat exchangers 40 and 54 are preferably air to air devices and are manufactured by EXOTHERMICS, Inc. of Toledo, Ohio. The preferred burner 116 is an Eclipse burner manufactured by Eclipse, Inc. of Rockford, Ill.

The combustion system has a number of unique features. It can be seen that during certain process load conditions damper 50 is caused to modulate which in turn varies the amount of exhaust air passing through the incinerator. The variation can be in the order of 3:1. Thermal incinerator burners, thus far have only been capable of a flow variation of 1.5:1 or 2:1 while maintaining efficient combustion.

The burner and associated combustion chamber have been configured to allow a 3:1 variation in air flow while maintaining proper turbulence and incineration. This is achieved by passing part of the fume through the burner and part through an orifice and mixing by means of a target plate 125. This is shown in FIG. 3.

Various modifications and additions to the disclosed embodiment will occur to those skilled in the art, and accordingly, the foregoing description is not to be construed in a limiting sense.

We claim:

1. Incinerator apparatus with a self-contained preheater for input effluent comprising:

a generally cylindrical housing having first and second axial ends and further having an inlet and an outlet adjacent the first end;

a combustion chamber within said housing and offset toward the second end;

said combustion chamber having a burner and said combustion chamber further being radially spaced from said housing to permit effluent to flow therearound;

an annular bundle of essentially straight exhaust tubes extending axially within said housing from said combustion chamber to said outlet for conveying hot effluent from said combustion chamber;

said tubes being loosely spaced apart to permit cool effluent entering said inlet to flow between and around said tubes within said housing;

at least one annular bulkhead sealingly attached to the interior of said housing and supporting said tubes and having an open center so that cool inlet effluent may flow through said open center but not around said annular bulkhead;

at least one solid bulkhead connected to said tubes, radially spaced from the interior of said housing but having a closed center so that effluent may flow around but not through said solid bulkhead;

said annular and solid bulkheads being axially spaced within said housing between said inlet and said combustion chamber to cause cool effluent to flow repeatedly between and around said tubes enroute from said inlet to said combustion chamber.

2. Apparatus as defined in claim 1 further including spacer means connected between the combustion chamber and the interior of said housing for supporting said combustion chamber.

* * * * *